United States Patent [19]

Marchetti

[11] Patent Number: 4,642,966

[45] Date of Patent: Feb. 17, 1987

[54] MACHINE FOR CLOSING THE TOP END FLAPS OF BOXES HAVING FOLDING FLAPS

[76] Inventor: Augusto Marchetti, Piazza Sicilia, 7, 20146 Milano, Italy

[21] Appl. No.: 836,133

[22] Filed: Mar. 4, 1986

[30] Foreign Application Priority Data

Mar. 6, 1985 [IT] Italy ..... 21011/85[U]

[51] Int. Cl.[4] ..... B65B 7/20

[52] U.S. Cl. ..... 53/374; 493/183

[58] Field of Search ..... 53/374, 375, 491; 493/183, 177, 453

[56] References Cited

U.S. PATENT DOCUMENTS 4,218,862 8/1980 Marchetti ..... 53/374

4,262,468 4/1981 Marchetti ..... 53/374 X 4,363,219 12/1982 Luyett et al. ..... 53/374

*Primary Examiner*—James F. Coan

*Attorney, Agent, or Firm*—Cushman, Darby & Cushman

[57] ABSTRACT

A rotatable disc support bears at its front end a first closing member for the front flap of the box and at the rear end a second closing member for the rear flap of the box. The second closing member consists of a vane pivoted on the disc support and contained, in the rest position, in the space occupied by said support.

7 Claims, 12 Drawing Figures

Figure 1:
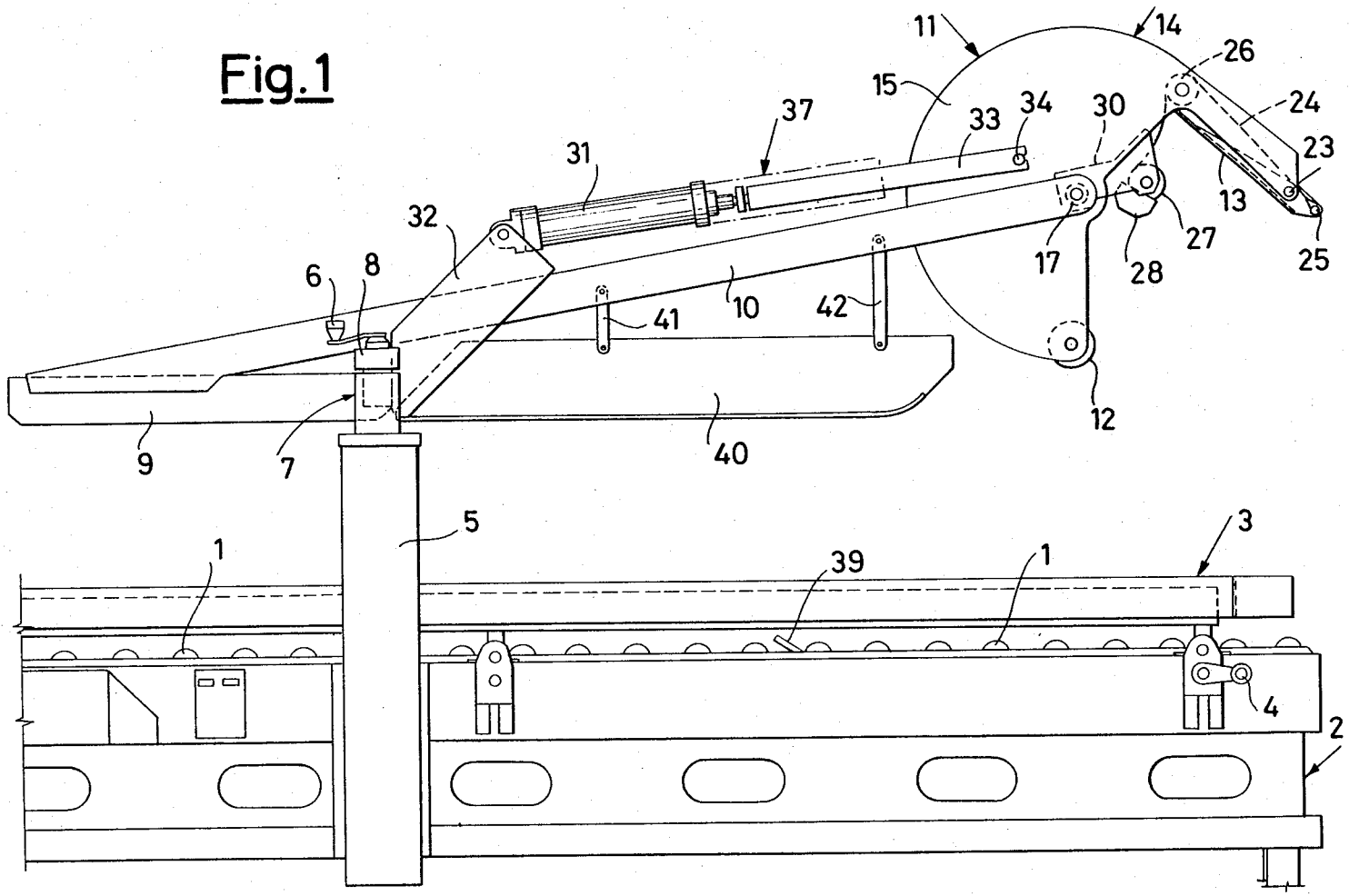

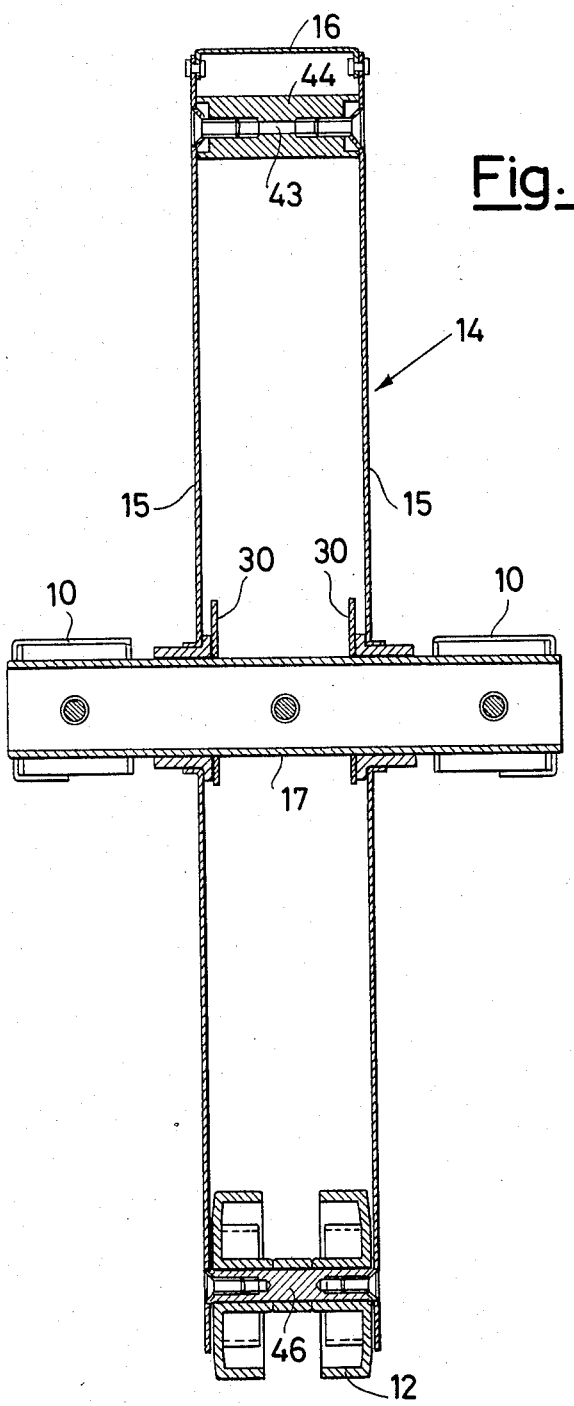
Fig. 4
Fig. 5
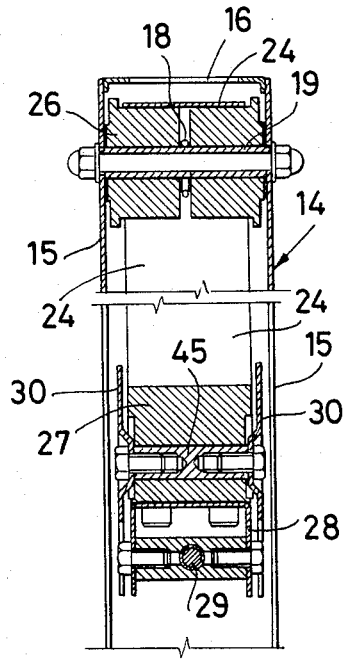

MACHINE FOR CLOSING THE TOP END FLAPS OF BOXES HAVING FOLDING FLAPS

The present invention relates to a machine for closing the top end flaps of boxes with folding flaps.

It is known that to pack many products, e.g. tinned products, there are used parallelepiped cardboard boxes with folding flaps which are taken from the storeroom in flat conditions, arranged on a filling table in upright and widened position with the lower flaps appropriately folded in the closing position, and then filled with the products.

For the subsequent closing of the top flaps of the boxes thus filled there are used at present automatic machines in which along a predetermined path of travel of the boxes are located appropriate devices capable of performing first closing of the end flaps (front and back), and then that of the side flaps.

The packing process is finally completed with the application of an adhesive sealing tape along the slit separating the folded side flaps, both top and bottom ones.

Closing machines presently in use include devices of various types for closing the end flaps.

One of the most effective solutions is surely that called for in the machine described in Italian patent application for industrial invention no. 20372 A/78 filed Feb. 17, 1978 in the name of the applicant of the present application, in which the top end flap closing device comprises a first closing member for the front flaps and a second closing member for the rear flaps, born by respective ends of a common support in the form of an overturned V, which is rotatable on command from a first to a second work position to insert alternately one or the other of said members in the travel path of the top end flaps and make them at the same time operative with the different procedures dictated by the different operation which they must perform.

In accordance with this solution the first closing member is made up of a pair of integral arms which extend downward from the front end of said common support, on which they are pivoted and further restrained by elastic means which stress them in the vertical position. The second closing memberis in turn made up of a vane pivoted on the rear end of the common support and further restrained at a fixed point of the machine by flexible connection means which react to the rotation of said common support from the first to the second work position in such a manner as to bring about a reverse rotation of said vane from a neutral inclined position to a horizontal working position which allows said vane to accompany the rear flap until it is completely overturned in the closing position.

The object of the present invention is to accomplish a machine for the closing of the top end flaps of boxes with folding flaps in which the closing of the end flaps is accomplished by a device which, referring for some features to the device of the aforesaid previous application, is however constructionally different, more compact, and simpler and more economical.

In accordance with the invention said object is achieved by a machine of the type comprising a supporting plane for the boxes, means for conveying the boxes along said supporting plane and, located above said supporting plane along the travel path of the boxes, a first closing member for the front end flaps of the boxes and a second closing member for the rear end flaps of the boxes, said closing members being born by a single support which is rotatable on command from a first to a second position, in said first position said first closing member being inserted in the travel path of the top end flaps of the boxes to engage from the front the front flap and overturn it to the closing position and said second closing member being outside said path, in second position said first closing member being outside the travel path of the top end flaps of the boxes and said second closing member being inserted in said path with combined descent and advance movement at a speed greater than that of the boxes to engage from behind the top flap and overturn it to the closing position, said second closing member being made up of a vane pivoted on said support and further restrained at a fixed point of the machine by flexible connection means which react to the rotation of said support from said first to said second position in such a manner as to bring about a reverse rotation of said vane from a neutral inclined position to a horizontal working position which allows said vane to accompany the rear flap until it is completely overturned to the closing position, characterized in that said rotatable support is made in the form of a boxed disc extended basically for three quarters of a circle and pivoted on its central axis, a front end of said disc bearing and constituting a housing for said first closing member and a rear end of said disc bearing in a turning manner said vane in such a manner as to constitute a housing therefor when it is in said neutral inclined position.

In this manner the entire end flap closing device forms a very compact constructionally and functionally simple assembly in which the rotatable support in the form of a boxed disc also functions as a protective casing for the closing members, making additional parts unnecessary. The cost is thus limited in comparison with the previously known solution.

Figure 2:
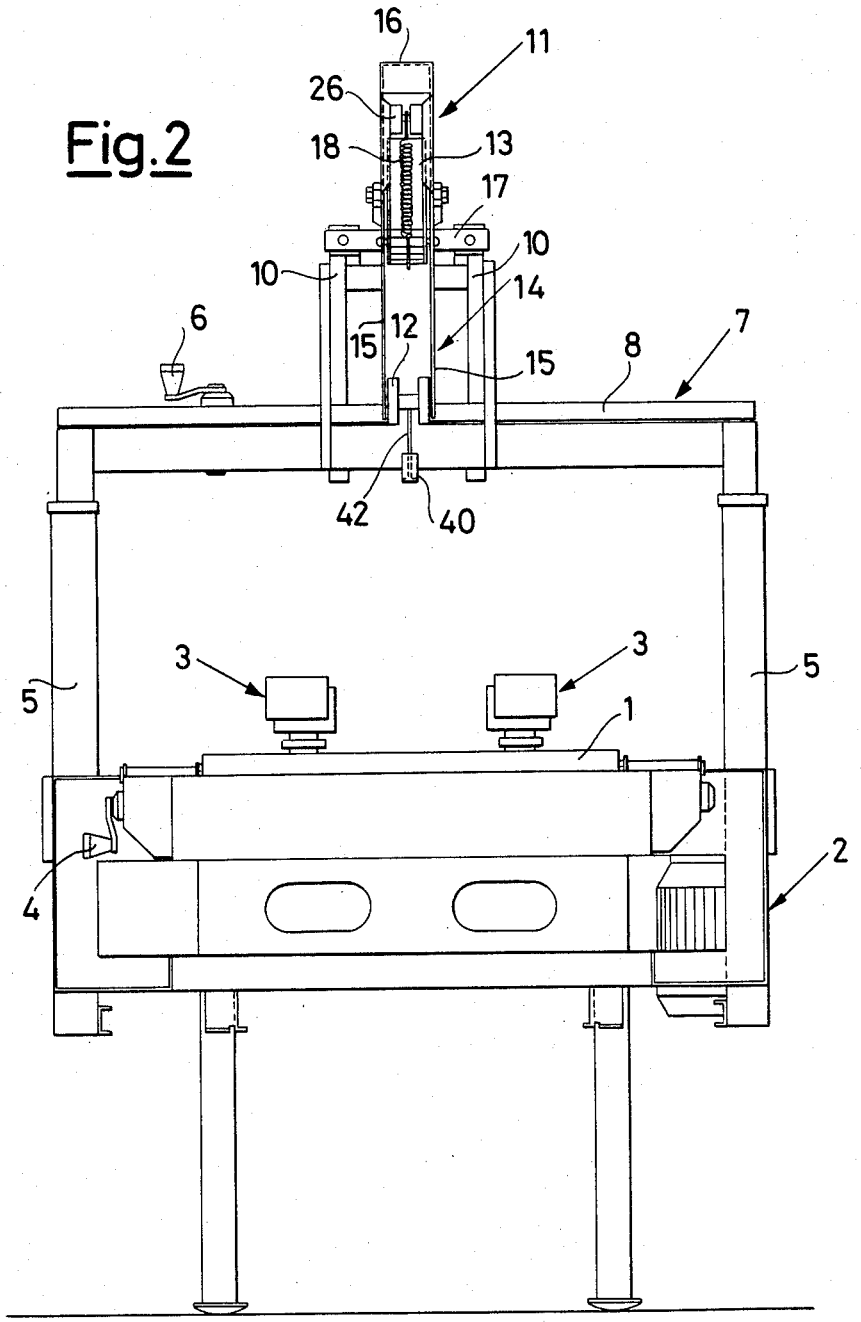
Figure 3:
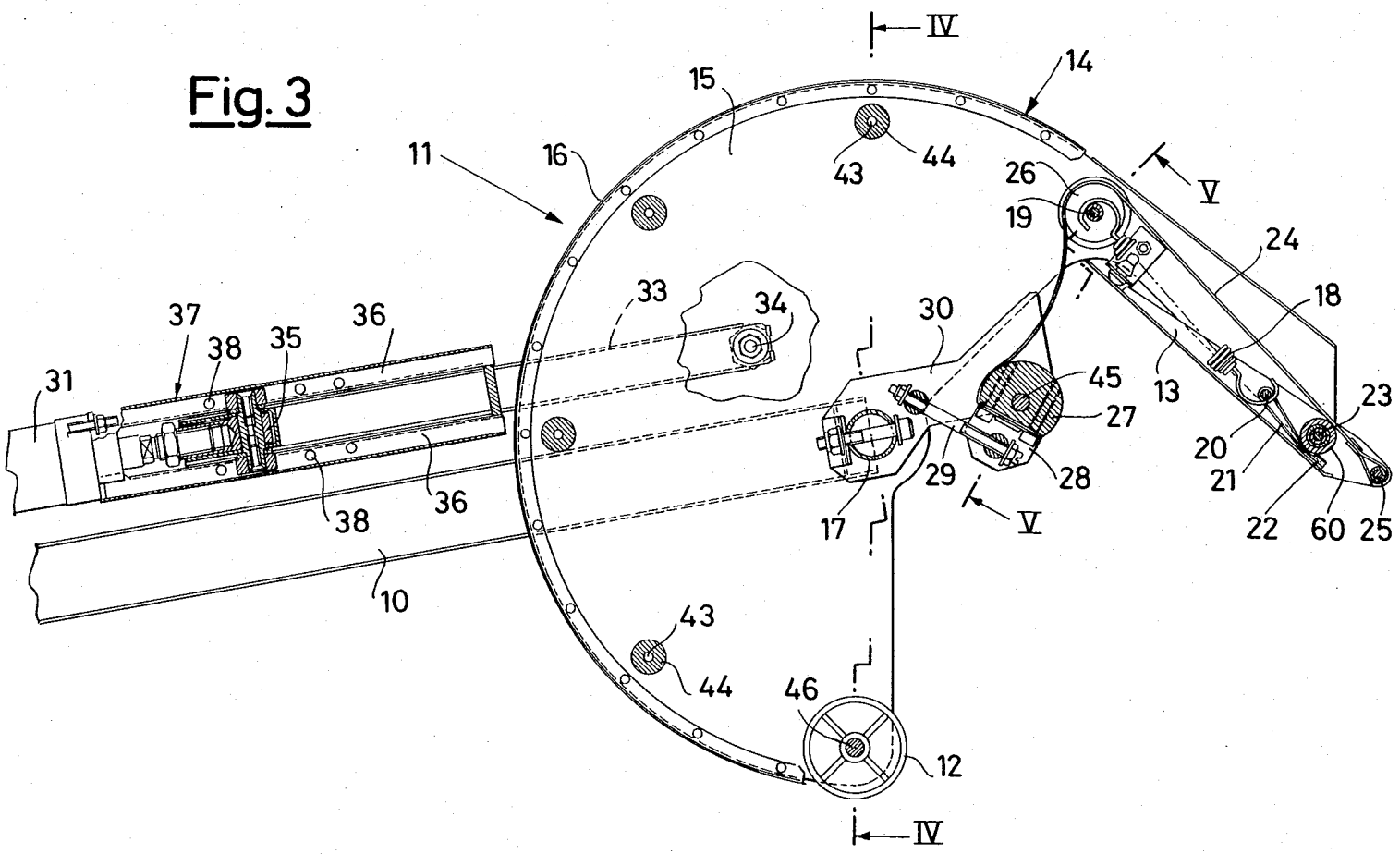
Figure 6:
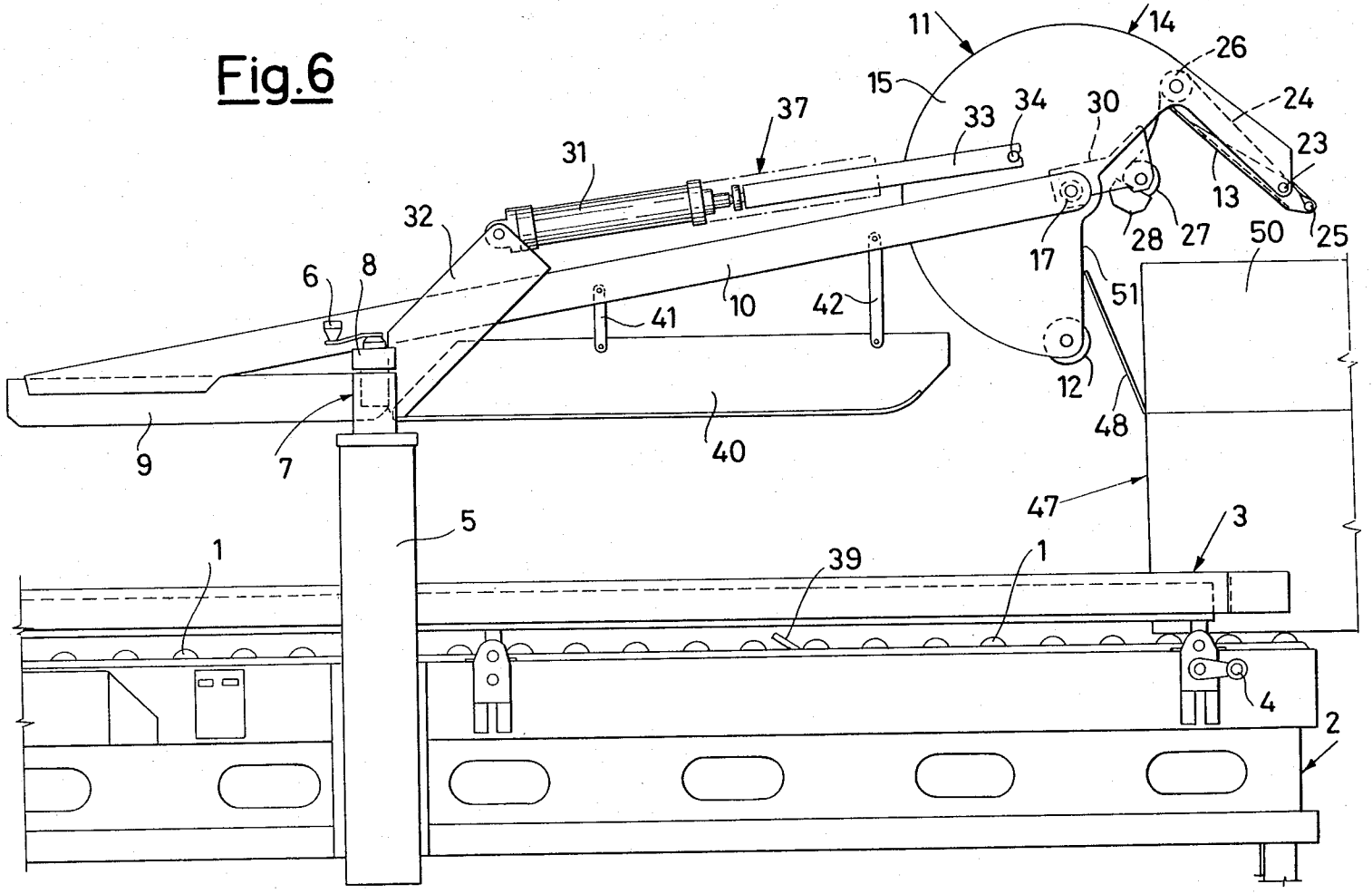
Figure 7:
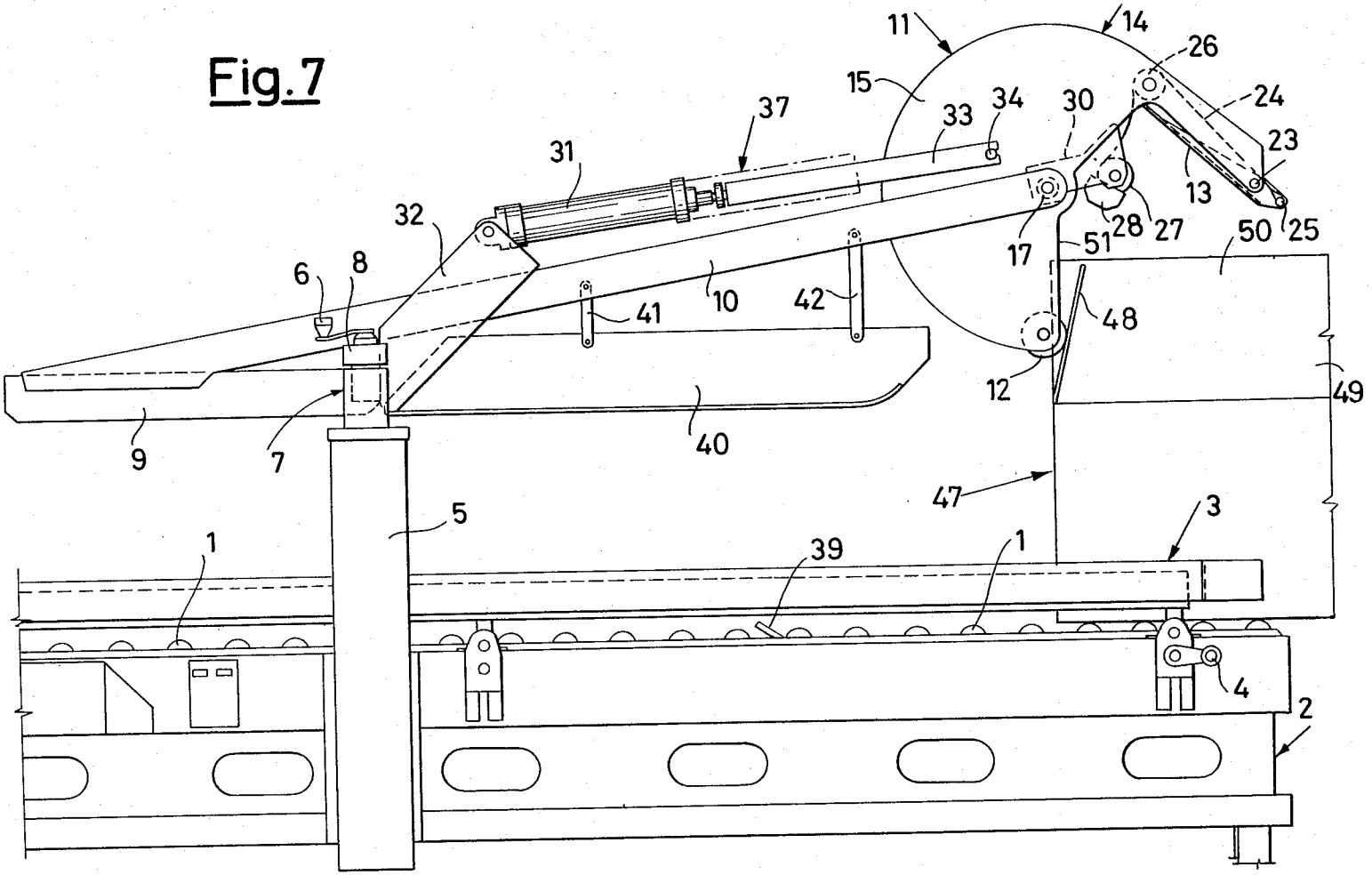
Figure 8:
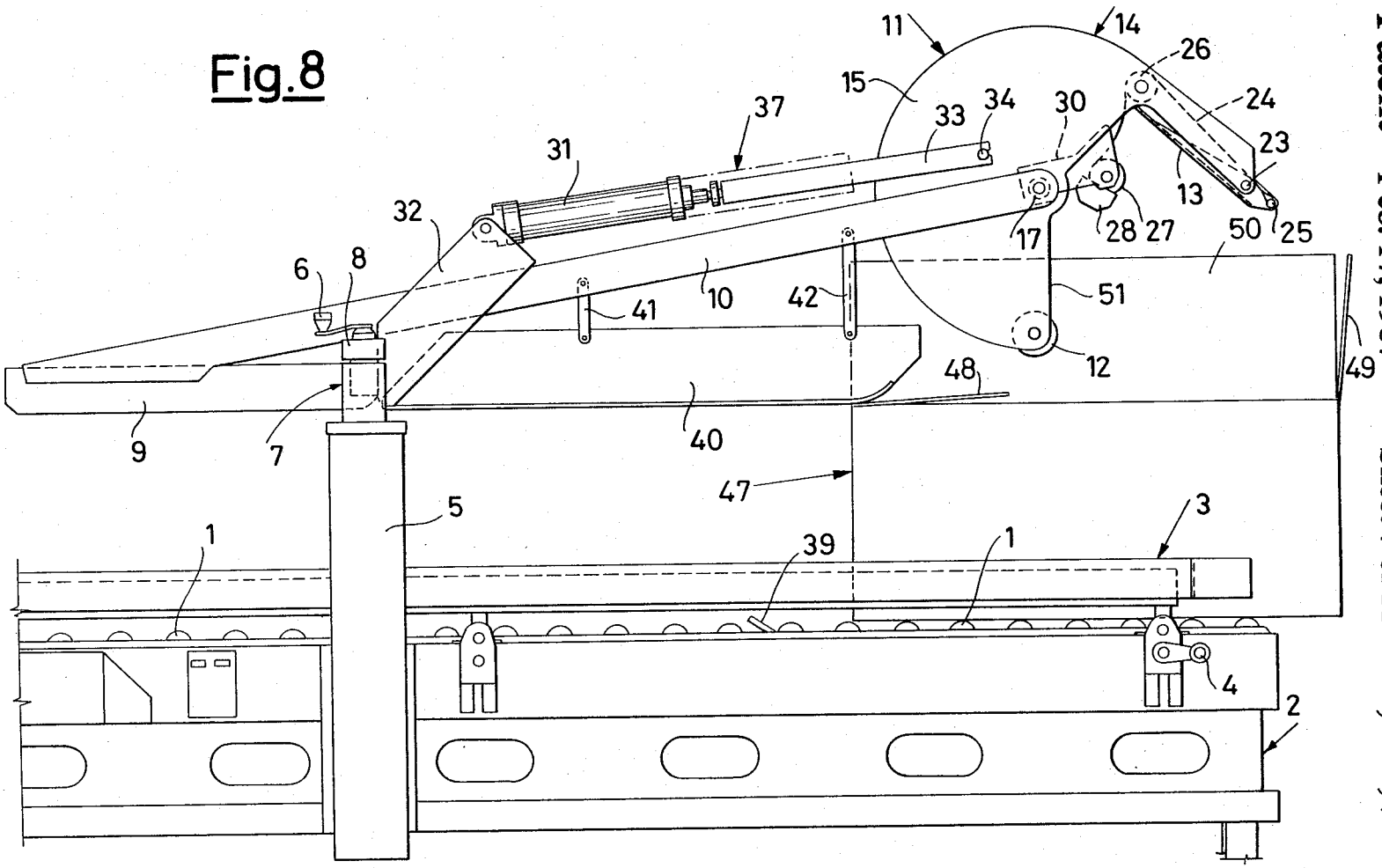

An example of a practical embodiment of the machine in accordance with the invention is illustrated for greater clarity in the annexed drawings wherein:

FIG. 1 shows a side view of a machine in accordance with the invention in neutral position, FIG. 2 shows a front view of said machine from the box inlet end, FIG. 3 shows an enlarged longitudinal sectional detail view of the top end flap closing device which is included in said machine, FIG. 4 shows a sectional view of said device along line IV—IV of FIG. 3, FIG. 5 shows a sectional view of said device along line V—V of FIG. 3, and FIGS. 6–12 show a side view of said machine at various instants of the closing operation of the top end flaps of a box.

The machine shown in the drawings and in particular in FIGS. 1 and 2 comprises first of all a supporting and conveying plane for the boxes which is described by a series of idle rollers 1 supported by a bed 2. At the two sides of said supporting plane are arranged two belt pulling assemblies 3 which by known means operated by a crank 4 can be placed at an adjustable distance apart such as to allow their engagement with the sides of the boxes to advance said boxes (from right to left when viewing FIG. 1).

Two side columns 5 support in an adjustable vertical manner (by known means adjustable by a crank 6) a portal structure 7 including a crosspiece 8. From said crosspiece 8 extends in the direction of travel of the boxes a pair of horizontal arms 9 from which extends obliquely in the opposite direction a similar supporting structure having two arms 10 for a closing device of the top end flaps of the boxes, which is indicated as a whole by reference number 11.

The device 11 is illustrated in detail in FIGS. 3–5 and comprises basically a first closing member 12 for the top flap (considered in the direction of travel of the boxes), a second closing member 13 for the rear flap and a single rotatable support 14 for said closing members.

The rotatable support 14 is made in the form of a boxed disc extending for three quarters of a circle and engaged with the free end of the support structure 10 at its central axis. More precisely, the rotatable support 14 is formed of two vertical parallel side walls 15 made integral by screws 43 with spacing blocks 44 and by a curved closing wall 16 and mounted in a turning manner on a central tubular pin 17 (FIGS. 3 and 4) fixed to two arms of the supporting structure 10.

A (front and lower) end of the rotatable disc support 14 bears in a turning manner and constitutes a housing for the first closing member 12 which is made in the form of a double idle roller turning on the pin 46 (FIGS. 3 and 4). The other (rear and upper) end of said support 14 bears in turn in a turning manner at 23 the second closing member 13, which is made in the form of a vane held normally in a rest oblique position (FIG. 3), housed inside the support 14, by a spring 18 reacting between a pin 19 fixed to the support 14 and a pin 20 to which is also coupled a flexible loop tape 21 which is in tangential contact with a roller 60 turning on a pin 23 and integral with the vane 13 and terminates coupled to a shoulder 22 fixd to the vane. Another flexible tape of fixed length 24 is in turn coupled to another pin 25 fixed to the vane 13, turns about a transmission roller 26 mounted on the pin 19 which is fixed to the support 14 and terminates gripped between a clamp 27 and a bracket 28, which are respectively pivoted at 45 and fixed with screws 29 between a pair of side walls 30 which are fixed to the tubular pin 17 (FIGS. 3–5). The useful length of the tape 24 is adjustable by means of the screw 29 and is selected in such a manner as to allow the vane 13 to hold itself in the oblique position shown in FIG. 3 when the rotatable support 14 is in the rest position shown in FIGS. 1 and 3 but also to force it, by reaction, to move from said oblique position and to the horizontal position shown in FIG. 12 (passing through the intermediate positions shown in FIGS. 8–11) when the rotatable support 14 is commanded to rotate clockwise from the angular position shown in FIGS. 1 and 3 to that shown in FIG. 12.

To command the rotation of the support 14 there is provided a hydraulic cylinder 31 (preferably operated by compressed air) which reacts between a pair of brackets 32 fixed to the crosspiece 8 and a pair of straight rods 33 pivoted at 34 on the side walls of the disc support 14. As shown in FIG. 3, the attachment of the two mated rods 33 to the piston stem of the hydraulic cylinder 31 is accomplished by a T-joint 35 whose wings are housed in a sliding manner in straight guides 36 of a surrounding boxed structure 37 fixed to the cylinder 31. Said guides 36 are equipped with a series of holes 38 in which are insertable locking pins for fixing, if desired, rest angular positions different from those shown in FIG. 3 for the rotatable support 14. The purpose thereof will be clarified below.

Figure 11:
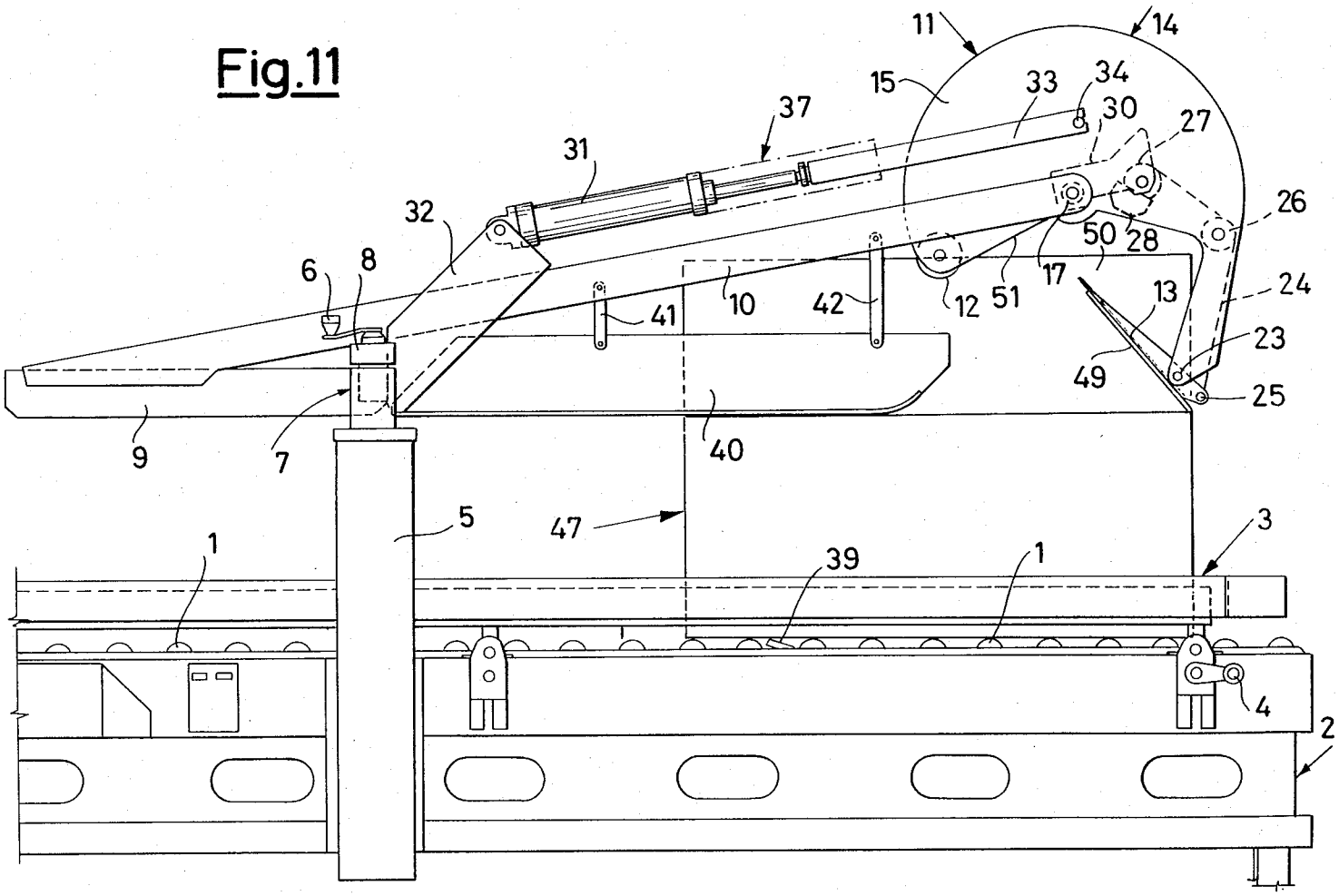
Figure 12:
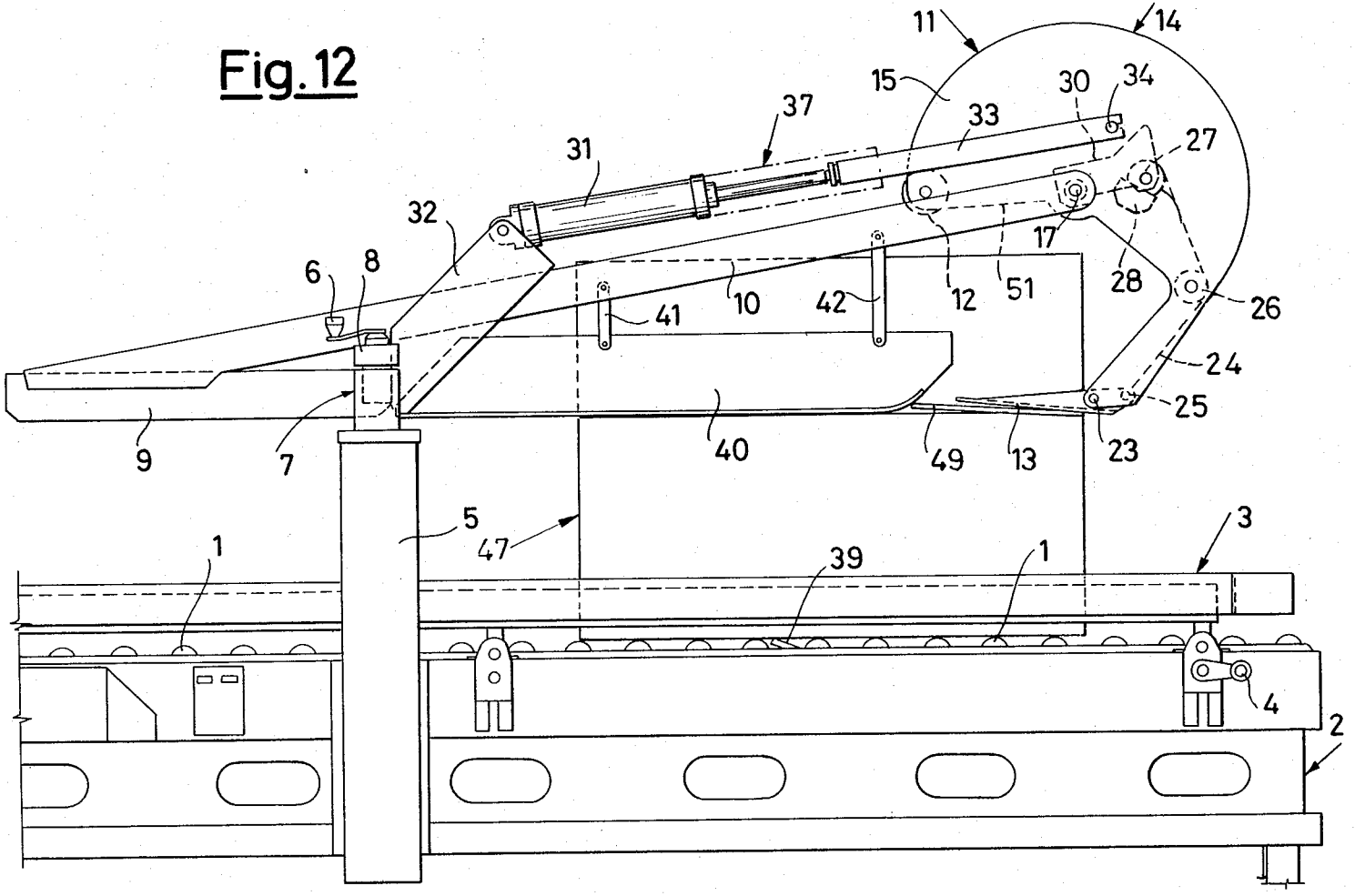

The cylinder 31 is actuated for clockwise rotation of the support 14 from the initial position shown in FIG. 1 to the final position shown in FIG. 12 by a member sensitive to the position of the box along the plane of conveyance described by the rollers 1, which is represented in an exemplary manner in FIGS. 1 and 6–12 in the form of a lever means 39 inserted between one roller and the next in an appropriate position in such a manner as to be engaged by the bottom of the box.

The machine illustrated in the drawings comprises finally downstream from the closing device 11 a member for holding the end flaps in the closing position, which is made up of an overturned T structure 40 (known in itself) supported in a horizontal position by the oblique structure 10 by means of a pair of parallel rods pivoted at 41 and 42. As can be seen in FIGS. 1 and 2 the lower horizontal wing of said structure 40 is in lowered position in relation to the roller 12 which is born by the rotatable support 14. The consequences thereof will be explained below.

The manner of operation of the machine illustrated in the drawings and in particular of the closing device 11 appears clearly in FIGS. 6–12.

Once the initial adjustment of the distance apart of the pulling assemblies 3 and of the vertical position of the crosspiece 8 and of the members supported thereby is made, a box 47 having a front top flap 48, a rear top flap 49, and side top flaps 50, all in an erect position, is placed on the supporting plane of the machine to be engaged at the sides by the pulling assemblies 3 and thus pulled forward from one end (right) to the other end (left) of said supporting plane.

In this condition, with the closing device 11 in the neutral position of FIG. 1, i.e. with the roller 12 in the travel path of the top end flaps 48 and 49 and the vane 13 outside of said path, the introduced box reaches the closing device 11, precisely the lower front edge 51 of the disc support 14 (FIG. 6), which arranges the flap in erect position before it is engaged by the idle roller 12 (FIG. 7) to be then overturned to the closing position. Said overturning is finally completed by the overturned T structure 40 (FIG. 8) which arranges and holds the front flap 48 in the correct horizontal closed position. This series of operations, which derives from the vertical position selected for the roller 12, causes a progressive and effortless closing movement which correctly positions the front flap, thus avoiding subjection thereof to harmful stresses.

Figure 9:
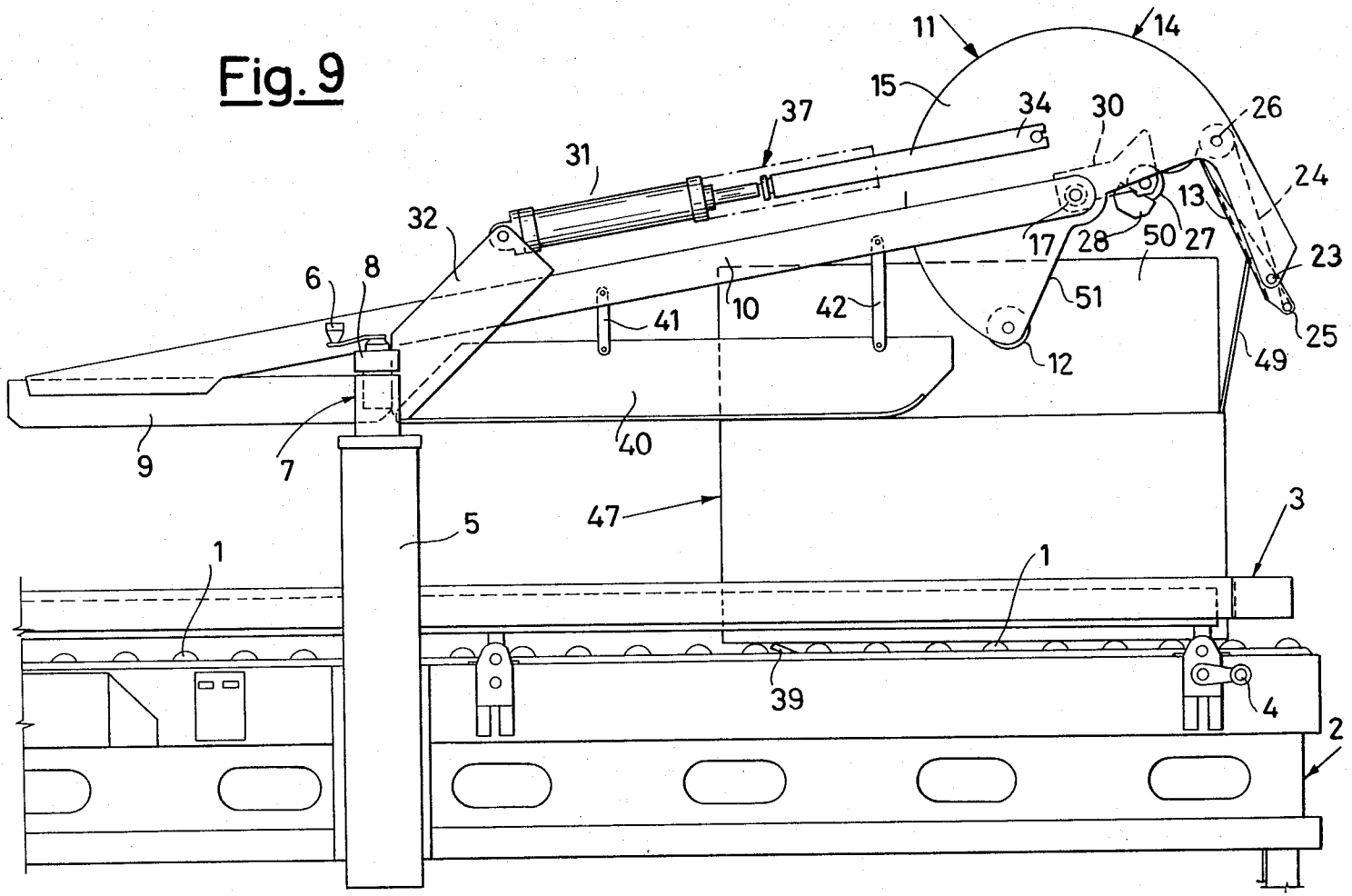
Figure 10:
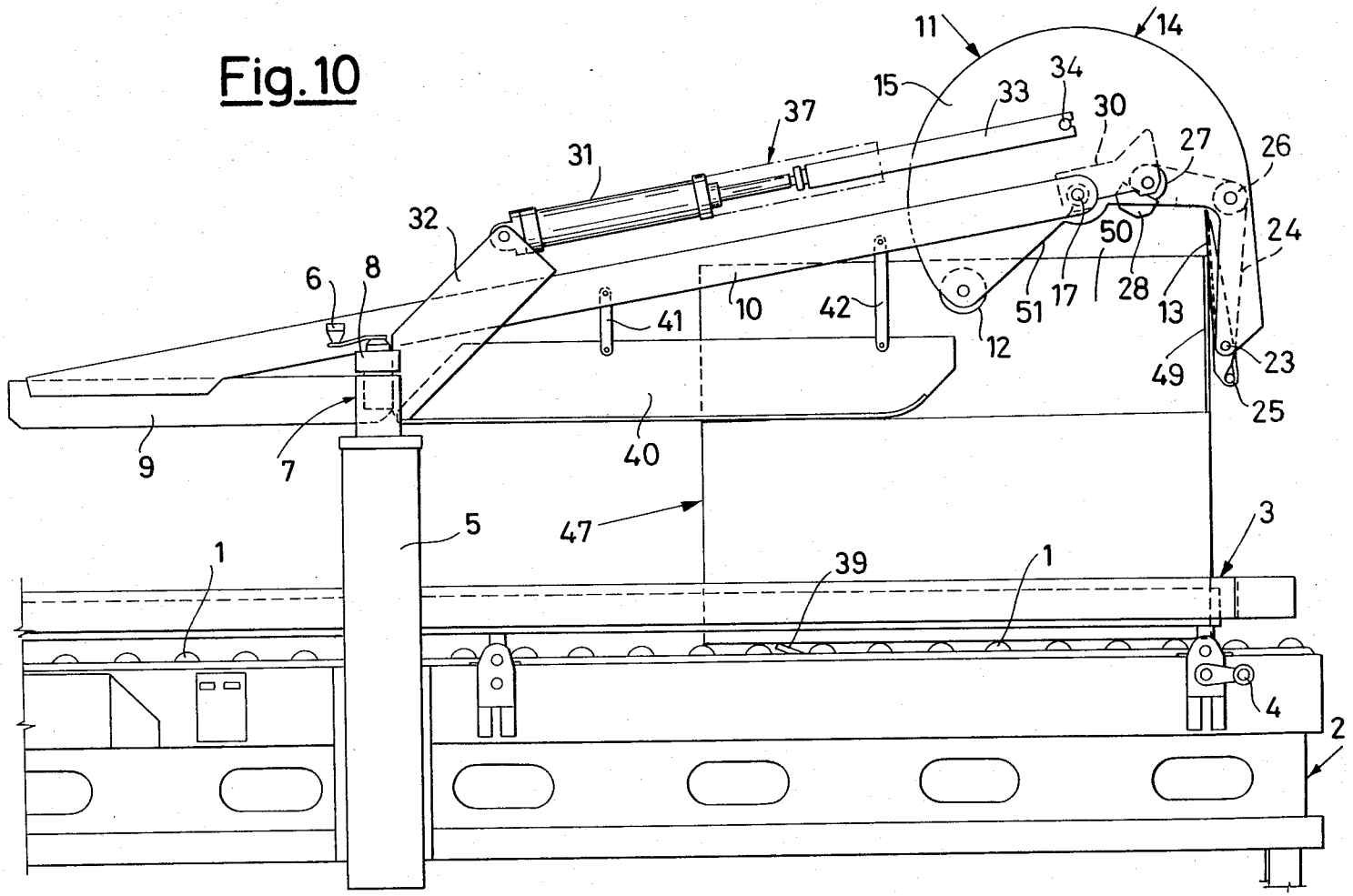

As the box continues its travel, its bottom reaches a point where it engages with the sensitive lever 39 which in lowering causes through appropriate valve means activation of the cylinder 31. By lengthening in relation to the neutral position shown in FIGS. 6–8 the cylinder 31 causes clockwise rotation of the disc support 14, which withdraws the roller 12 from the advancing box and at the same time approaches thereto the vane 13 with a combined lowering and advancing movement at a speed greater than the travel speed of the box which brings said vane 13 to a point where it engages from behind the rear flap 49 of the box (FIG. 9). As a result the rear flap is first brought to the erect position (FIG. 10) and then pushed towards the closed position.

As the disc support 14 continues to rotate together with the travel of the box, the fixed length tape 24 has its path increased between the attachment points 25 and 27–28 and over the roller 26 so that it becomes taut and then causes by reaction the reverse rotation of the vane 13 around the pin 23. As illustrated in FIGS. 11 and 12 the vane 13 rotates progressively from the vertical position shown in FIG. 10 to the oblique position shown in FIG. 12, bringing about by its movement the progressive overturning of the rear flap 49 to the fully closed position suitable for engagement thereof with the overturned T holding structure 40. In the meantime the roller 12 has moved completely out of the path of travel of the rear flap.

The end flaps 48 and 49 are thus closed and the other members (not shown and independent of the characteristics of the present invention) can close the side flaps and apply a sealing adhesive tape along the longitudinal slit separating the overturned side flaps on both the top and the bottom of the box.

For the following boxes the above sequence is repeated. If the dimensions of the boxes vary, it may prove necessary to make a preliminary adjustment of the position of the pulling assembly 3 and of the crosspiece 8, acting on the cranks 3 and 6 respectively. At the same time it may be necessary to shift the sensitive member forward or backward along an appropriate guide.

It may also happen that boxes with flaps shorter than the distance between the roller 12 and the structure 40 make useless the long rotation travel of the disc support 14 from the rest position shown in FIG. 1 to the final position showin FIG. 12.

In this case it will be appropriate to change the rest position by inserting in one of the holes 38 of th boxed structure 37 a pin capable of limiting the return travel of the cylinder 11. In such a manner, after each closing sequence the support 14 makes a more limited return travel to which also corresponds in the following sequence a forward travel which is correspondingly limited.

The production rate of the machine can thus be increased.

I claim:

1. Machine for closing the top end flaps of boxes with overturnable flaps comprising a supporting plane for the boxes, means for advancing the boxes along said supporting plane and, located above said supporting plane along the path of travel of the boxes, a first closing member for the front end flap of the boxes and a second closing member for the rear end flap of the boxes, said closing members being born by a single support rotatable on command from a first to a second position, in said first position said first closing member being inserted in the path of travel of the top end flaps of the boxes to engage from the front the front flap and overturn it to the closing second position and said second closing member being outside said path, in said position said first closing member being outside the path of travel of the top end flaps of the boxes and said second closing member being inserted in said path with a combined descent and advance movement at a speed greater than that of the boxes to engage from behind the rear flap and overturn it to the closing position, said second closing member being made up of a vane pivoted on said support and further restrained at a fixed point of the machine by flexible connection means which react to the rotation of said support from said first to said second position in such a manner as to bring about a reverse rotation of said vane from a rest inclined position to a horizontal working position, which allows said vane to accompany the rear flap until it is completely overturned to the closing position, characterized in that said rotatable support is made in the form of a boxed disc extended for three quarters of a circle and pivoted on its central axis, a front end of said disc bearing and constituting a housing for said first closing member and a rear end of said disc bearing in a turning manner said vane in such a manner as to constitute a housing therefore when it is in said rest inclined position.

2. Machine in accordance with claim 1 characterized in that said first closing member consists of an idle roller.

3. Machine in accordance with claim 1 characterized in that said machine comprises a member for holding the end flaps in the closing position, said holding member consisting of an overturned T structure with a horizontal wing arranged at a height lower than that of said first closing member.

4. Machine in accordance with claim 1 characterized in that said disc support is formed of a pair of parallel vertical side walls rigidly connected together.

5. Machine in accordance with claim 1 characterized in that said disc support is supported in a turning manner by a supporting structure fixed to a crosspiece with adjustable height above said supporting plane.

6. Machine in accordance with claim 5 characterized in that said supporting structure develops obliquely upward in a direction opposite to the direction of travel of the boxes.

7. Machine in accordance with claim 1 characterized in that said machine comprises means for modifying said first position of said disc support.

* * * * *